United States Patent [19]

Welsh

[11] Patent Number: 4,941,847

[45] Date of Patent: Jul. 17, 1990

[54] ELECTRICAL CONNECTOR CONTACT RETENTION SYSTEM

[75] Inventor: David E. Welsh, Tustin, Calif.

[73] Assignee: ITT Corporation, New York, N.Y.

[21] Appl. No.: 384,579

[22] Filed: Jul. 24, 1989

[51] Int. Cl.[5] ..... H01R 13/424

[52] U.S. Cl. ..... 439/595; 439/589; 439/733; 439/744

[58] Field of Search ..... 439/587, 689, 752, 688, 439/274, 744, 599, 733, 869, 871, 271, 595

[56] References Cited

U.S. PATENT DOCUMENTS

| | | | |
|---|---|---|---|
| 3,068,443 | 12/1962 | Nava et al. | 439/587 |
| 3,143,385 | 8/1964 | Zimmerman, Jr. et al. | 339/217 |
| 3,336,569 | 8/1967 | Nava | 339/217 |
| 3,517,376 | 6/1970 | Sarazen et al. | 339/192 |
| 3,621,444 | 11/1971 | Stein | 339/14 |
| 3,671,920 | 6/1972 | Iantorno et al. | 339/59 |
| 3,812,447 | 5/1974 | Eifler et al. | 439/733 |
| 4,084,877 | 4/1978 | Knickerbocker | 339/97 |
| 4,113,333 | 9/1978 | Horowitz | 339/14 |
| 4,195,901 | 4/1980 | Lindlau | 339/198 |
| 4,284,320 | 8/1981 | Nix et al. | 339/200 |
| 4,611,880 | 9/1986 | Petersen et al. | 339/206 |
| 4,641,909 | 2/1987 | Steffinger | 339/210 |
| 4,645,278 | 2/1987 | Yevak, Jr. et al. | 339/17 |
| 4,772,231 | 9/1988 | Hayes | 439/752 |

*Primary Examiner*—Gary F. Paumen

*Attorney, Agent, or Firm*—Thomas L. Peterson

[57] ABSTRACT

A connector is provided which retains its contacts in a simple, reliable, and low cost manner, without requiring retaining clips. A housing that holds the contacts includes two insulative layers with aligned contact-receiving holes, the first layer (50 in FIG. 2) formed of rigid material and the second layer (52) formed of elastomeric material. Each contact has a rearwardly-facing first shoulder (66) that engages a first abutment (74) formed in the first rigid layer, to withstand large mating forces as the connector is moved forwardly to mate with another connector. Each contact also has a second forwardly-facing shoulder (72) that engages a second abutment (76) in the second elastomeric layer, to withstand the lower unmating forces. The contact has forward and rearward parts (66, 70), one forming the first shoulder and the other forming the second shoulder. The hole (54) in the forwardmost layer is large enough to readily pass the rearwardmost one of the contact parts (70) to enable installation and removal of the contacts from the front of the housing.

5 Claims, 3 Drawing Sheets

FIG. 1
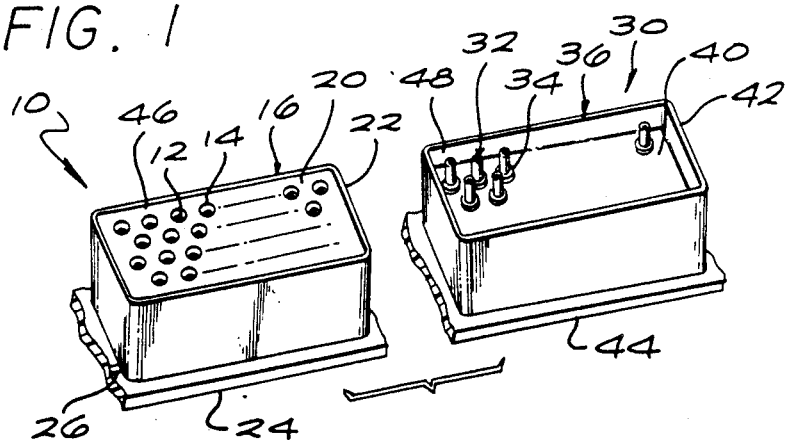
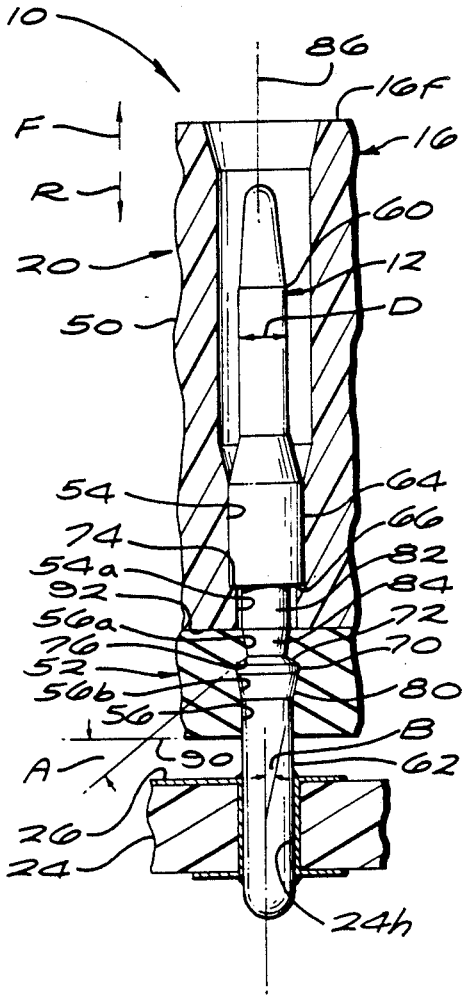
FIG. 2

ELECTRICAL CONNECTOR CONTACT RETENTION SYSTEM

BACKGROUND OF THE INVENTION

High reliability connectors such as those used in defense applications, have generally included housing layers with contact-receiving holes. Clips lying in the holes hold the contacts against rearward mating forces while allowing the contacts to be replaced by the use of special tools. The use of clips to retain contacts has several disadvantages. If a clip fails during mating of contacts, when the maximum force is applied to the clips, a contact can be pushed out of the insulative layer, possibly damaging circuitry to which the tail or termination end of the contact is attached. In addition to the reliability problem, clips are expensive. A system for retaining contacts which avoided the use of clips while providing high reliable resistance to mating forces and moderately high resistance to unmating forces for replaceable contacts, would be of considerable value.

SUMMARY OF THE INVENTION

In accordance with one embodiment of the present invention, a connector is provided wherein contacts thereof are reliably held in place in a low cost and reliable manner. The connector housing includes a pair of insulative layers having aligned holes, with the first layer formed of rigid material and the second formed of elastomeric material. Each contact has a forward mating portion, a first part forming a rearwardly-facing shoulder, and a second part forming a forwardly-facing shoulder. The rigid first layer has an abutment that abuts the rearwardly-facing first shoulder to withstand mating forces, while the elastomeric second layer has an abutment that abuts the forwardly-facing second shoulder to resist unmating forces on the contact.

One of the insulative layers of the connector housing is forwardmost, and one of the contact parts is forwardmost and the other rearwardmost. The hole in the forwardmost layer is preferably large enough to readily pass the rearwardmost part of the contact. In one connector the rigid layer is forwardmost, and the first part of the contact which forms the first shoulder that resists unmating forces is wider than the second part of the contact which forms the second shoulder. In another embodiment of the invention, the arrangement is reversed, with the elastomeric layer being forwardmost.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded perspective view showing plug and socket connectors constructed in accordance with the present invention, that can be mated to each other, each connector being shown mounted on a circuit board.

FIG. 2 is a partial sectional view of the plug connector of FIG. 1.

DESCRIPTION OF THE PREFERRED EMBODIMENTS

Figure 3:
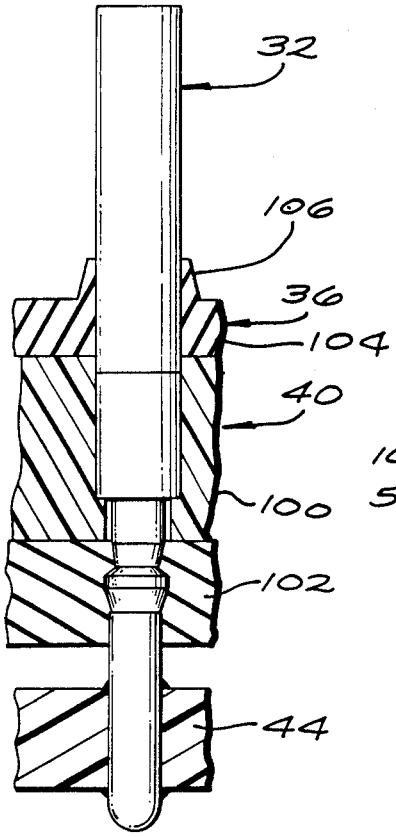
FIG. 3 is a partial sectional view of the socket connector of FIG. 1.

FIG. 1 illustrates a first or plug connector 10 which has multiple first or plug contacts 12 lying in holes 14 of a connector housing 16. The housing includes insulation 20 and a shell 22 around the insulation. The connector 10 is shown mounted on a circuit board 24, with the multiple contacts 12 connected to conductive traces such as shown at 26 on the circuit board. The system includes a second or socket connector 30 with multiple socket contacts 32 lying in holes 34 of a housing 36. The housing also includes an insulation 40 surrounded by a shell 42. The second connector is similarly mounted on a second circuit board 44. The connectors have forward or mating ends 46, 48, and the connectors can be connected together by moving their mating ends against each other, with each contact of the plug connector 10 mating with a corresponding contact of the socket connector 30.

FIG. 2 illustrates a portion of the plug connector 10, showing how a plug contact 12 is installed in the insulation of the connector housing 16. The housing insulation includes a first layer 50 of rigid insulative material such as a hard moldable plastic, and a second elastomeric layer 52 such as of rubber. The layers have aligned contact-receiving holes 54, 56. The plug contact 12 includes a forward mating portion 60 and a rearward tail portion 62, the forward and rearward directions indicated by the arrows F and R.

Each contact has a first part 64 forming a rearwardly-facing first shoulder 66. Each contact also has a second part 70 forming a forwardly-facing shoulder 72. The insulative layers are formed with abutments that abut the contact shoulders. The rigid layer 50 has a forwardly-facing abutment 74 that engages the first contact shoulder 66. The elastomeric layer 52 has a rearwardly-facing abutment 76 that engages the second contact shoulder 72. The first shoulder and first abutment 74 serve to resist the high mating forces applied to the contact in the rearward direction R during mating with another contact. The fact that the abutment 74 is on a rigid material, enables the connector to withstand relatively high mating forces. The second shoulder 72, that engages the second abutment 76 formed in elastomeric material, enables the contact to withstand moderate unmating forces, which are applied in the forward direction F, and which are generally much lower than the mating forces.

The presence of the second abutment 76 in an elastomeric material, facilitates installation of the contacts in the housing, and the removal and replacement of a contact with another one. The hole 54 in the forwardmost layer 50 has a narrowest part **54*a*. The contact is installed from the largely planar forward end or face 16*f* of the housing by projecting the contact in a rearward direction R. During such projection, the tail end 62 and second part 70 of the contact readily pass through the hole 54 in the first layer. The second part 70 of the contact has a tapered displacer 80 that is tapered to be progressively narrower at progressively more rearward locations therealong. As the contact is pushed rearwardly, the displacer 80 displaces rubber at a narrow forward hole part 56*a* of the second layer 52** by deflecting it outwardly. Finally, the second contact shoulder 72 snaps behind the second abutment 76 into a wider middle hole part 56*b*, at which time the contact is fully installed. It may be noted that the distance between the contact shoulders 66, 72 is preferably slightly less than the distance between the insulator abutments 74, 76, so that when the second shoulder 72 snaps in place, the first shoulder 66 is pressing firmly against the first abutment 74.

The contact 12 is formed with a spacer portion 82 that connects the first and second parts 64, 70 of the contact. The spacer portion is long enough so there is a considerable thickness of rigid insulation rearward of the first shoulder 66 and of elastomeric insulation forward of the second shoulder 72. The rearward end 84 of the spacer portion is tapered to have a progressively smaller width at progressively rearward locations. This provides a greater area of rubber against which the second shoulder 72 presses.

The first shoulder 66 and first abutment 74 extend perpendicular, or about 90°, from the axis 86 of the contact as seen in the side view of FIG. 2, to provide high resistance to mating forces. The second shoulder 72 extends at an angle A of about 30° from a radial direction 90. This angle is provided to avoid damage to the elastomeric layer when a high forward force is applied to remove the contact so it can be replaced by another one. It may be noted that the displacer 80 of the second part of the contact extends at an angle B which is preferably no more than about 30° from the axis 86 (or at least 60° from the radial direction 90) to enable installation of the contact with minimum force.

It should be noted that the rigid and elastomeric layers 50, 52 are bonded together at their interface 92 in a vapor-tight seal, which prevents water vapor or other contaminants from leaking into the contact-receiving holes after two connectors have been mated. It also may be noted that the present connector is primarily useful for contacts with short termination ends 62, such as pins that connect to circuit boards or wire wrap terminals, as such terminations facilitate installation of the contacts from the forward end 16*f* of the connector housing.

FIG. 3 illustrates a socket contact 32 lying in the housing 36. The insulation of the housing includes a rigid first layer 100 and an elastomeric second layer 102 which are constructed and which function in the same manner as in FIG. 2. However, the housing also includes a third layer 104, of elastomeric material, lying at the front of the housing and forming interfacial seals 106.

Figure 4:
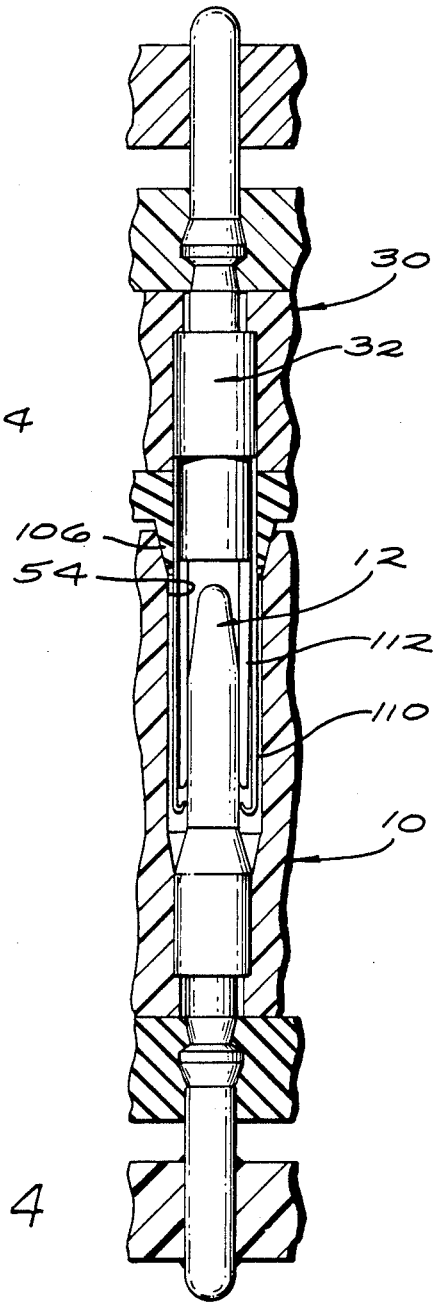
FIG. 4 is a partial sectional view of the connectors of FIG. 1, shown mated to each other.
Figure 5:
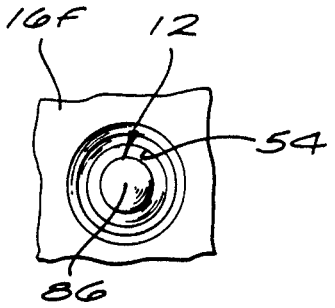
FIG. 5 is a plan view of the connector portion of FIG. 2.

FIG. 4 shows the plug and socket connectors 10, 30 connected, with the respective contacts 12, 32 mated. The socket contact 32 includes a hood 110 that surrounds and protects resilient fingers 112 of the socket contact. The interfacial seal 106 seals to the outer end of the hole 54 in the plug connector.

Figure 6:
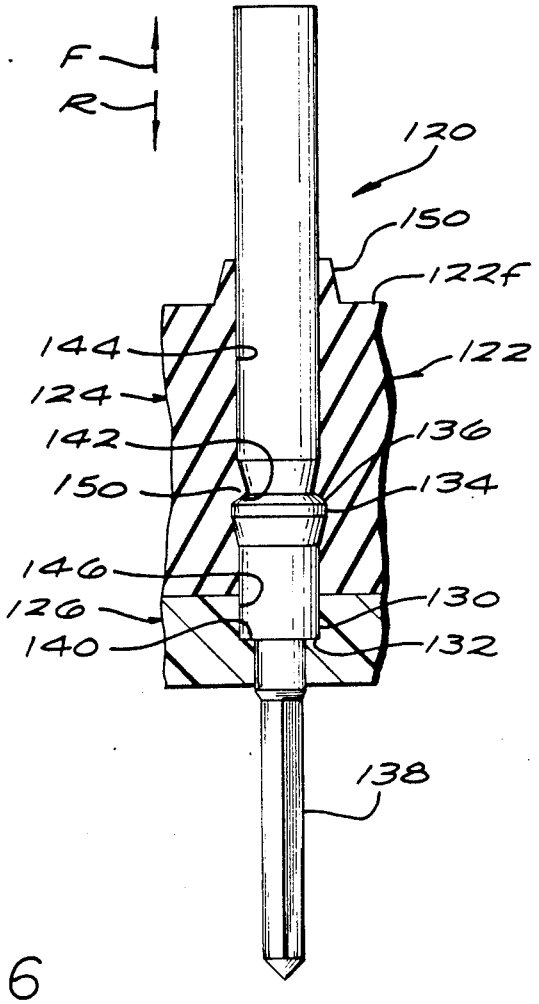
FIG. 6 is a partial sectional view of a connector constructed in accordance with another embodiment of the invention.

FIG. 6 illustrates a portion of another socket connector 120, whose housing 122 is constructed with an elastomeric insulative layer 124 lying forward of a rigid insulative layer 126. As in the contact of FIG. 2, the contact has a first part 130 that forms a rearwardly-facing first shoulder 132, and a second part 134 that forms a forwardly-facing second shoulder 136. However, in this connector the second shoulder 134 lies forward of the first shoulder 132. The rigid layer 126 forms a first abutment 140 that engages the first shoulder 132, while the elastomeric layer 124 forms a second abutment 142 that abuts the second shoulder 136. The termination, or tail end portion 138 is shown here as a wire wrap pin.

The holes 144, 146 in the elastomeric and rigid layers 124, 126 and the first and second contact parts 130, 134 are formed to facilitate installation of the contact from the front end 122*f* of the housing. The first part 130 of the contact preferably is of a smaller diameter than the second part 134. The hole 144 in the elastomeric layer is preferably large enough to enable the first part 130 to fit therethrough, with only moderate force (to deflect a constrictive portion 150 of the elastomeric layer that forms part of the second abutment 142). It is possible to construct the first part 130 with a diameter equal to or greater than the diameter of the second part 134, but this requires tapering around the shoulders 132 to avoid damage during installation. A pin connector can be constructed using the same approach, to mate with a socket contact recessed into a closed entry cavity.

The design of FIG. 6 has some advantages over that of FIG. 3, in that the same elastomeric layer 124 that forms the second abutment 142 that withstands unmating forces, also forms an interface seal 150. However, the rubber elastomeric layer may not position the front ends of the contacts as precisely as a rigid layer. For the type of plug contact shown in FIG. 2 where the mating end of each contact is closely surrounded by an insulative layer, it is generally desirable that the forward layer be the rigid one. Applicant has designed connectors of the type illustrated in FIGS. 2–5, with the diameter D (FIG. 2) of the mating end of each plug contact being 40thousandths inch in one design and 60 thousandths inch in another, these connectors being designed for use in airplanes. The elastomeric layer is of sixty shore hardness rubber. It may be noted that in FIG. 1, the diameter D of the mating end 60, the diameter of the spacer portion 82, and the diameter of the termination portion 62 are all the same, this being preferred to reduce the cost of manufacture.

The connector of FIG. 2 can be constructed by molding the rigid and elastomeric layers 50, 52 separately and bonding their facewise adjacent faces to each other as with a bonding agent. It is possible to place another layer between them, but there is generally no advantage to this. Each plug contact 12 is machined from metal and then installed in the two bonded-together layers by inserting the termination end 62 of the contact into the front end 16*f* of the connector. The only appreciable force is required when the second part 70 of the contact must be pressed through front portion of the hole 56 in the elastomeric layer. The termination end 62 fits through a plated-through hole 24h in the circuit hole 24 and is soldered in place (the construction of the circuit boards in other FIGS. is not shown).

Thus, the invention provides a connector which retains its contacts in the connector insulation in a manner that holds the contacts very securely against mating forces and with moderate strength against unmating forces, while permitting replacement of a contact, all without the need for retention clips. This is accomplished by forming the connector insulation with a rigid first layer having an abutment that abuts a rearwardly-facing shoulder on the contact to resist mating forces, and by providing an elastomeric second layer with a second abutment that abuts a second forwardly-facing shoulder on the contact to resist unmating forces. In one arrangement the rigid layer is frontmost, while in another arrangement that is especially useful for socket contacts, the elastomeric layer is frontmost and forms an interface around the mating end of each contact.

Although particular embodiments of the invention have been described and illustrated herein, it is recognized that modifications and variations may readily occur to those skilled in the art and consequently it is intended to cover such modifications and equivalents.

What is claimed is:

1. In an electrical first connector which includes a housing holding a plurality of first contacts for mating with the contacts of another connector, the improvement wherein:

said housing includes first and second layers, each formed of an insulative material, said layers having a plurality of aligned contact-receiving holes;

said first contacts lie in said aligned holes of said housing layers, and each contact includes a forward mating portion and a rearward tail portion, and each contact includes a rearwardly-facing first shoulder and a forwardly-facing second shoulder;

said first layer being formed of rigid insulative material and each hole therein having a forwardly-facing abutment that abuts said first shoulder of one of said contacts, to withstand mating forces on the contact;

said second layer being formed of elastomeric material and each hole therein having a rearwardly-facing abutment that engages said second shoulder of one of said contacts.

2. The improvement described in claim 1 wherein:

each of said first contacts has first and second parts that respectively form said first and second shoulders, said first contact part lies forward of said second contact part, and said second contact part that forms said second shoulder is narrower than said first contact part that forms said first shoulder;

said rigid first layer lies forward of said elastomeric second layer, each of said holes in said first layer is at least as wide as said second contact part to readily pass it as the contact is inserted in a rearward direction into the front of said housing, and each hole is said elastomeric second layer has a front portion narrow enough to pass said second contact part only by forcing said contact rearwardly therethrough until said second contact shoulder lies behind said rearwardly-facing abutment.

3. The improvement described in claim 1 wherein:

each of said contacts has an axis;

each of said contacts includes a spacer with a rear forming a rearward-radially inward taper of a taper angle B of no more than 60° with said axis, to help displace material of said second layer during insertion of the contact.

4. The improvement described in claim 3 wherein:

each of said contacts has an axis;

said second shoulder extends at an Angle A of about 30° from a radial direction, to enable removal with minimum damage to the elastomeric layer.

5. The improvement described in claim 1 wherein:

the distance between said first and second contact shoulders is slightly less than the distance between said first and second layer abutments.

* * * * *